US011036168B2

(12) United States Patent
Kabata et al.

(10) Patent No.: US 11,036,168 B2
(45) Date of Patent: Jun. 15, 2021

(54) IMAGE FORMING METHOD FOR METALLIC SHEETS

(71) Applicants: Toshiyuki Kabata, Kanagawa (JP); Megumi Arai, Kanagawa (JP); Akira Azami, Kanagawa (JP); Toshiaki Motohashi, Chiba (JP)

(72) Inventors: Toshiyuki Kabata, Kanagawa (JP); Megumi Arai, Kanagawa (JP); Akira Azami, Kanagawa (JP); Toshiaki Motohashi, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/815,084

(22) Filed: Mar. 11, 2020

(65) Prior Publication Data

US 2020/0301328 A1 Sep. 24, 2020

(30) Foreign Application Priority Data

Mar. 19, 2019 (JP) ..... JP2019-051102

(51) Int. Cl.
*G03G 15/20* (2006.01)
*G03G 15/00* (2006.01)

(52) U.S. Cl.
CPC ..... *G03G 15/2053* (2013.01); *G03G 15/206* (2013.01); *G03G 15/2064* (2013.01);
(Continued)

(58) Field of Classification Search
CPC ..... G03G 15/2053; G03G 15/2064; G03G 15/206; G03G 15/6588; G03G 15/6591;
(Continued)

(56) References Cited

U.S. PATENT DOCUMENTS 5,168,315 A * 12/1992 Osawa ..... G03G 7/006 399/328
9,442,442 B1 * 9/2016 Hara ..... G03G 15/2046
(Continued)

FOREIGN PATENT DOCUMENTS

JP 61-215793 9/1986
JP 2016-021037 2/2016
(Continued)

OTHER PUBLICATIONS

Zhao, D., Qian, X., Gu, X., Jajja, S. A., and Yang, R. (Oct. 6, 2016). "Measurement Techniques for Thermal Conductivity and Interfacial Thermal Conductance of Bulk and Thin Film Materials." ASME. J. Electron. Packag. Dec. 2016; 138(4): 040802. https://doi.org/10.1115/1.4034605 (Year: 2016).*

*Primary Examiner* — Walter L Lindsay, Jr.
*Assistant Examiner* — Laura Roth
(74) *Attorney, Agent, or Firm* — Oblon, McClelland, Maier & Neustadt, L.L.P.

(57) ABSTRACT

An image forming method for an image forming apparatus having a fixing rotator and a pressure rotator opposite the fixing rotator includes transferring white toner and color toner onto a surface of a metallic sheet. The metallic sheet has a thermal conductivity of 0.34 W/m·K or less as measured by hot-wire method. The transferring process forms an unfixed color toner layer layered on an unfixed white toner layer on the metallic sheet. Further, the method includes conveying the metallic sheet, with the surface on which the white toner layer and the color toner layer being transferred facing the fixing rotator, between the fixing rotator heated and the pressure rotator to fix the white toner layer and the color toner layer onto the metallic sheet.

9 Claims, 2 Drawing Sheets

(52) U.S. Cl.
CPC ..... *G03G 15/6585* (2013.01); *G03G 15/6591* (2013.01); *G03G 2215/00476* (2013.01); *G03G 2215/209* (2013.01)

(58) Field of Classification Search
CPC ..... G03G 15/1625; G03G 15/6585; G03G 2215/00443; G03G 2215/00447; G03G 2215/00476; G03G 2215/00493; G03G 2215/00523; G03G 2215/209
See application file for complete search history.

(56) References Cited

U.S. PATENT DOCUMENTS

| | | | | |
|---|---|---|---|---|
| 2007/0154687 | A1* | 7/2007 | Luthi ..... | B42D 25/387 428/195.1 |
| 2015/0370206 | A1 | 12/2015 | Hitosugi et al. | |
| 2016/0154345 | A1 | 6/2016 | Nagata | |
| 2018/0024462 | A1 | 1/2018 | Shimada et al. | |
| 2018/0088506 | A1* | 3/2018 | Weinstein ..... | B41M 5/0011 |
| 2019/0079433 | A1* | 3/2019 | Watanabe ..... | G03G 15/657 |
| 2019/0212685 | A1 | 7/2019 | Matsumoto et al. | |

FOREIGN PATENT DOCUMENTS

| | | |
|---|---|---|
| JP | 2016-102909 | 6/2016 |
| JP | 2016-139001 | 8/2016 |

* cited by examiner

IMAGE FORMING METHOD FOR METALLIC SHEETS

CROSS-REFERENCE TO RELATED APPLICATION

This patent application is based on and claims priority pursuant to 35 U.S.C. § 119 to Japanese Patent Application No. 2019-051102, filed on Mar. 19, 2019 in the Japan Patent Office, the entire disclosure of which is hereby incorporated by reference herein.

BACKGROUND

Technical Field

Embodiments of the present disclosure generally relate to an image forming method and an image forming apparatus.

Background Art

In the printing industry, to make printed materials stand out, images are printed on metallic sheets to make posters, book covers, packages, product tags, various cards, POP advertisements and store fixtures on display racks. These images have great impact and good advertising effects because the non-image portions are shiny and glittering.

The images are often printed on the metallic sheets by offset printing, which is suitable for large-volume printing but is not cost-effective for small-volume printing. Since the metallic sheets themselves are expensive, small-volume printing, for example, printing images on 100 metallic sheets or less, is more desirable than large-volume printing.

An electrophotographic image forming method is suitable for small-volume printing, but at present, rarely used for printing images on metallic sheets. One of the reasons lies in the characteristics of the image formed on the metallic sheet by the electrophotographic image forming method. Forming an image having a large image area with cyan, magenta, yellow, and black toner on the metallic sheet darkens the image and reduces the impact.

A countermeasure for the above-described disadvantage is to place a white layer under the image, but a general electrophotographic image forming apparatus forms images using cyan, magenta, yellow, and black toner and cannot form the white layer under the image. In contrast, recently, an industrial electrophotographic image forming apparatuses having white toner in addition to four color toners, that is, cyan, magenta, yellow, and black toner has been put into practical use.

SUMMARY

This specification describes an improved image forming method for an image forming apparatus having a fixing rotator and a pressure rotator opposite the fixing rotator. The method includes transferring white toner and color toner onto a surface of a metallic sheet having a thermal conductivity of 0.34 W/m·K or less as measured by hot-wire method to form an unfixed color toner layer layered on an unfixed white toner layer on the metallic sheet and conveying the metallic sheet, with the surface on which the white toner layer and the color toner layer are transferred facing the fixing rotator, between the fixing rotator heated and the pressure rotator to fix the white toner layer and the color toner layer onto the metallic sheet.

BRIEF DESCRIPTION OF THE DRAWINGS

The aforementioned and other aspects, features, and advantages of the present disclosure would be better understood by reference to the following detailed description when considered in connection with the accompanying drawing, wherein.

Figure 1:
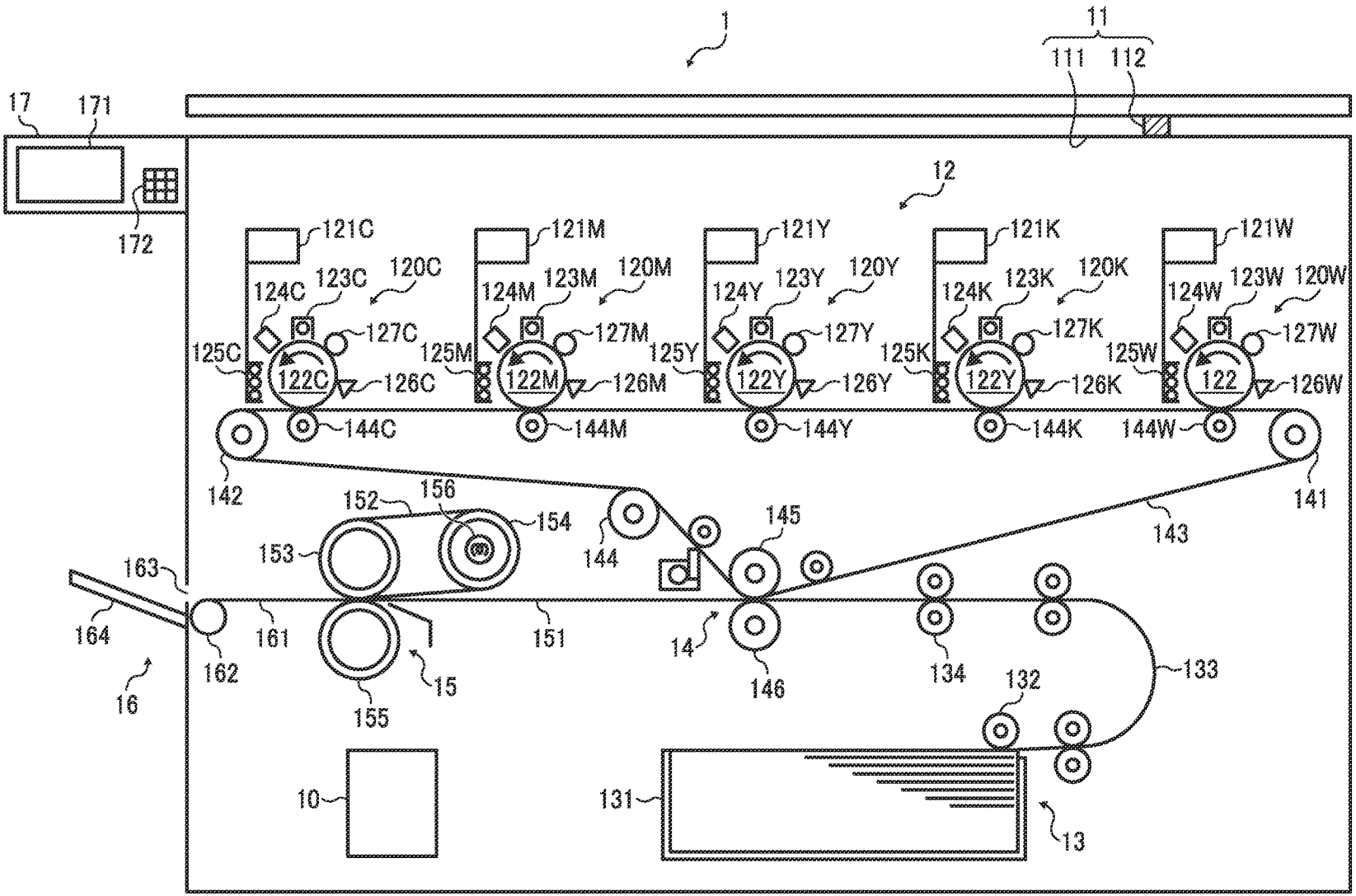
FIG. 1 is a schematic explanatory diagram illustrating an example of an image forming apparatus according to the present disclosure.

The accompanying drawing is intended to depict embodiments of the present disclosure and should not be interpreted to limit the scope thereof. The accompanying drawing is not to be considered as drawn to scale unless explicitly noted.

DETAILED DESCRIPTION OF EMBODIMENTS

A description is provided of an image forming method and an image forming apparatus according to the present disclosure with reference to the drawing.

In describing embodiments illustrated in the drawing, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawing, such description is not intended to limit the scope of the disclosure and all of the components or elements described in the embodiments of this disclosure are not necessarily indispensable.

Moreover, it is to be noted that the present disclosure is not to be considered limited to the following embodiments, but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

The present inventors formed images on various types of metallic sheets using an electrophotographic image forming method and found that most commercially available metallic sheets do not have satisfactory adhesion between the metallic sheet and a toner layer that forms the toner image. The metallic sheets more preferable for offset printing tended to have poor adhesion. A sample having better adhesion than other samples but poor image quality was found and examined. Toner of the surface of the toner layer was sufficiently melted.

However, when the above-described sample was bent, separation of the toner layer from the metallic sheet in a film form was found in many parts. On the other hand, the present inventor found that a part of the toner layer did not separate from the metallic sheet in the film form even when a crack is formed in the toner layer. A detailed examination of the part of the toner layer that did not separate from the metallic sheet in the film form revealed that melted toner was intertwined with the surface layer of the metallic sheet at the interface between the surface layer of the metallic sheet and the toner layer that forms the toner image, and the toner layer and the metallic sheet adhered to each other.

Using the above-described metallic sheet and changing the fixing temperature, the present inventors made and bent samples on which toner images were formed and observed the interface between the surface of the metallic sheet and the toner layer forming the toner image in each sample. As a result, the present inventors found that a higher fixing temperature decreased a number of parts in which the toner layer separated from the metallic sheet in the film form and provided better adhesion, in which the toner was intertwined with the surface layer of the metallic sheet at the interface between the surface layer of the metallic sheet and the toner layer that forms the toner image. On the other hand, the present inventors noticed that discoloration and deformation of the metallic sheet itself occur as the fixing temperature increases. Therefore, simply increasing the fixing temperature could not give a high-quality image.

The present inventors found that, to improve adhesion between the metallic sheet and the toner layer that forms the toner image, it is important for the toner to be intertwined with the surface layer of the metallic sheet at the interface between the surface layer of the metallic sheet and the toner layer and, for the toner to be intertwined with the surface layer of the metallic sheet, sufficiently increasing temperature at the interface is important. Therefore, the present inventors examined the temperature at the interface between the toner layer and the surface of the metallic sheet and found that the temperature was lower than expected. The present inventors investigated why the temperature becomes low at the interface between the surface of the metallic sheet and the toner layer that forms the toner image and found that the heat transmitted from the toner layer diffuses inside the metallic sheet to prevent the temperature at the interface between the surface of the metallic sheet and the toner layer from being kept sufficiently high.

As a result, the present inventors found that lower thermal conductivity of the metallic sheet results in better adhesion between the toner layer and the metallic sheet and high-quality images in an image forming apparatus not having a heater in a pressure roller, which results in the present disclosure.

Figure 2:
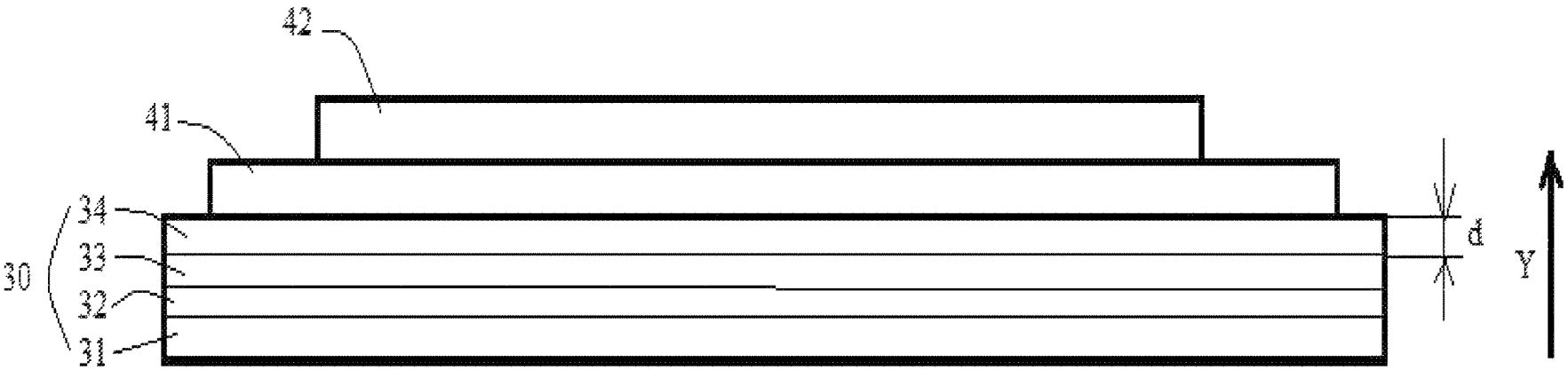
FIG. 2 is a schematic explanatory diagram illustrating a metallic sheet according to the present disclosure on which an unfixed color toner layer and an unfixed white toner layer are formed.

That is, with reference to FIG. 2, the image forming method according to the present disclosure includes transferring white toner and color toner onto a surface of a metallic sheet 30 having a thermal conductivity of 0.34 W/m·K or less as measured by hot-wire method to form an unfixed color toner layer 42 layered on an unfixed white toner layer 41 on the metallic sheet 30 as illustrated in FIG. 2 and conveying the metallic sheet 30, with the surface on which the white toner layer 41 and the color toner layer 42 are transferred facing the fixing rotator, between the fixing rotator heated and the pressure rotator to fix the white toner layer 41 and the color toner layer 42 onto the metallic sheet 30.

In the electrophotographic image forming method, when the metallic sheet bearing the toner image passes between a heated roller or a heated belt (hereinafter, referred to as a fixing belt) and a pressure roller, the transferred toner image contacts the fixing belt, and heat and pressure fix the toner image on the metallic sheet.

There are two types of fixing devices, that is, one that heats a pressure roller to a target temperature and the other that does not heat the pressure roller. In the fixing device having a heating mechanism in the pressure roller, the heated fixing belt heats the front surface of the sheet bearing the toner image, and the pressure roller also heats the back surface of the sheet.

Therefore, the above-described fixing device has advantages of high productivity of image formation and easy temperature control of the fixing belt but consumes a lot of energy. In addition, when a heated pressure rotator such as the heated pressure roller fixes the toner image onto the sheet, the fixing temperature may be too high, which may cause discoloration or deformation of the metallic sheet itself, and good quality may not be obtained. The heated pressure rotator may degrade the quality of the back surface of the sheet opposite to the front surface of the sheet bearing the white toner layer and the color toner layer.

The thermal conductivity of the metallic sheet 30 used in the image forming method of the present disclosure may be measured by the hot-wire method. The hot-wire method is a simple measuring method and can measure the thermal conductivity of the metallic sheet with good reproducibility. In the present disclosure, the measurement of the thermal conductivity of the metallic sheet by the hot-wire method was performed using a quick thermal conductivity meter QTM-500 manufactured by KYOTO ELECTRONICS MANUFACTURING CO.LTD, at 23±1° C. and 50±5%. The metallic sheet was placed on a reference sheet of known thermal conductivity, and the apparatus probe of the QTM-500 was placed on a metallic luster surface that is a surface which a metallic layer of the metallic sheet is seen. From the measurement results using quartz glass, silicon rubber, and silicon sponge rubber as the reference plate, the thermal conductivity is obtained.

The thermal conductivity of the metallic sheet 30 in the image forming method of the present embodiment is 0.34 W/m·K or less, and preferably 0.23 W/m·K to 0.33 W/m·K. When the thermal conductivity of the metallic sheet is larger than 0.34 W/m·K, the heat from the fixing belt diffuses to the entire metallic sheet, and adhesion between the toner layer and the surface of the metallic sheet deteriorates. Generally, the metallic sheet has a larger thermal capacity than ordinary thick paper because a plastic film including a metal layer is laminated on one side of the sheet.

The thermal conductivity of the metallic sheet may be adjusted by materials of the metallic sheet, thickness of each layer, and the like, and is greatly affected by the material and thickness of an adhesive layer. Appropriately changing these parameters can set the thermal conductivity of the metallic sheet to the above-described range.

The metallic sheet 30 in the present embodiment includes the metallic layer 33, which is also referred to as the metallic luster layer. The metallic layer 33 includes a metal and functions as a layer having metallic luster.

Examples of the metal contained in the metallic layer 33 include metal such as aluminum, silver, copper, and gold, alloys, aluminum dyes, and organic metals. Aluminum is preferable in terms of cost, whereas copper or gold are preferable to obtain colored metallic luster.

The metallic sheet 30 in the present embodiment includes a resin layer 34, which is also referred to as a plastic layer 34, a plastic film, or the like.

When the metallic layer 33 and the plastic layer 34 are laminated, the metallic layer 33 may be on either surface of the plastic layer 34, or a plurality of metallic layers 33 may be formed. Since the metallic sheet 30 having beautiful light reflection can be produced at low cost, preferably, the metallic layer 33 is laminated on one side of the plastic layer 34 and bonded to a base material 31 such as coated paper or high-quality paper. Since the metallic layer 33 has a higher thermal conductivity than other layers, it is preferable that the metallic layer 33 be between the plastic layer 34 and the base material 31 in order to prevent diffusion of heat in the surface of the metallic sheet 30.

The metallic layer 33 near the surface of metallic sheet 30 with low electrical resistivity may cause a discharge in a transfer process of the electrophotographic image forming method, which may degrade image quality and cause a failure of the image forming apparatus. The metallic layer 33 laminated on the plastic layer 34 by vapor deposition, sputtering, or the like tends to have low mechanical strength. Therefore, the metallic layer 33 is preferably formed at a position away from the surface of the metallic sheet to some extent d as illustrated in FIG. 2.

Based on a consideration of the above factors, the surface of the metallic layer 33 is preferably formed at a position of 10 μm to 100 μm from the surface of the metallic sheet 30 in the laminating direction Y in FIG. 2, more preferably 12 μm to 90 μm. The metallic sheet 30 having the surface of the metallic layer 33 in the preferable range becomes a print product having a beautiful metallic luster without causing discharge in the transfer process.

The metallic layer 33 may be formed by vapor deposition, a vacuum process by sputtering, electroless plating, painting with metallic ink, or applying a metal film or an alloy film with an adhesive. Preferably, the vacuum process or painting with metallic ink forms the metallic layer 33 because the metallic layer 33 is uniformly formed in a low-cost way.

The thickness of the metallic layer 33 is appropriately selected depending on the metallic luster, cost and the like required for the metallic sheet 30, but is preferably from 0.02 μm to 2 μm, more preferably from 0.03 μm to 1 μm, and still more preferably from 0.03 μm to 0.5 μm. The thickness of the metallic layer 33 is usually uniform but may be changed depending on positions on the metallic sheet 30 to form a pattern of the metallic layer 33 or an arbitrary shape of the metallic layer 33.

Preferably, the plastic layer 34 is transparent and has heat resistance to the heat applied in the fixing process in the electrophotographic process.

The plastic layer 34 that is the plastic film is made of, for example, a polyester film, a polyvinyl alcohol film, a polyvinylidene chloride film, or the like. The polyester film is preferred in consideration of transparency, thermal characteristics, mechanical strength, processability, and cost.

The film thickness of the plastic layer 34 may be appropriately changed depending on handleability, production cost, degree of metallic tone required for the metallic sheet, and the like. The film thickness is preferably from 10 μm to 100 μm, more preferably from 12 μm to 100 μm, and still more preferably from 12 μm to 80 μm. Setting the film thickness in the above preferable range prevents discharge in the transfer process, makes the metallic sheet 30 easier to process, makes the light reflection more beautiful, allows for easy post-processing such as folding, and prevents the cost from increasing.

The metallic sheet 30 in the present embodiment may include an anchor coat layer. The anchor coat layer is placed on the surface of the plastic layer.

High fixing temperatures can improve adhesion between the plastic layer 34 made of, for example, polyester and the toner layer made of toner including base particle made of polyester or styrene acrylic. However, the anchor coat layer disposed on the surface of the plastic layer 34 can lower the fixing temperature while maintaining good adhesion.

The anchor coat layer may be made of polyester resin, acrylic resin, styrene acrylic resin, polymethacrylate resin, paint made of the above-described resin, or adhesive made of the above-described resin. Among them, polyester resin and styrene acrylic resin are preferable because transparency and adhesion to toner are improved.

The thickness of the anchor coat layer is preferably from 0.1 μm to 15 μm, more preferably from 0.2 μm to 10 μm, and still more preferably from 0.5 μm to 9 μm. Generally, the thicker the anchor coat layer is, the better adhesion between the anchor layer and the toner layer tends to be. On the other hand, the thicker anchor layer causes toner to easily move during the fixing process, which degrades the resolution of the image. Therefore, the thickness of the anchor layer is determined based on the configuration of the image forming apparatus or the like.

The metallic sheet 30 in the present embodiment may be made by laminating the plastic layer 34 on the metallic layer 33 formed on the base material 31 by coating, vacuum forming, and the like. From the viewpoint of productivity and production cost, the metallic sheet 30 is preferably produced by bonding the plastic film having the metallic layer 33 to the base material 31 with an adhesive. The above-described process forms an adhesive layer 32 as illustrated in FIG. 2.

The adhesive that is heat-stable during the fixing process and has high adhesive strength may be used. A pressure-sensitive adhesive having flexibility is preferable because the metallic sheet 30 is often bent. Examples of adhesives include vinyl acetate resin, ethylene-vinyl acetate copolymer resin (EVA), acrylic resin, or the like. Above all, acrylic pressure-sensitive adhesive is preferable because the acrylic pressure-sensitive adhesive has good heat stability and a large thermal capacity that prevent heat from transferring between the plastic layer 34 and the base material 31 and decrease the thermal conductivity of the metallic sheet 30. The above-described adhesives are applied to at least one of the base material 31 and the plastic layer 34. After application of the adhesives, the plastic layer 34 coated with the adhesive is overlaid on the base material 31 or the metallic layer 33 and pressed. When the adhesive is reactive or contains a solvent, energy such as heat is appropriately applied to cure the adhesive layer 32. The adhesive is preferably the pressure-sensitive adhesive because the metallic sheet 30 can be made by applying the pressure-sensitive adhesive between the base material 31 and the plastic layer 34 having the metallic layer 33 and pressing the plastic layer 34 or the base material 31. The above-described acrylic pressure-sensitive adhesive is preferable because the acrylic pressure-sensitive adhesive is inexpensive and has workability that gives high processing accuracy.

The thickness of the adhesive layer 32 is preferably 0.8 μm to 15 μm, more preferably 1 Um to 12 μm. The thermal conductivity of the metallic sheet 30 is greatly affected by the thickness of the adhesive layer 32. The thicker the adhesive layer 32 formed by the pressure-sensitive adhesive is, the lower the thermal conductivity of the metallic sheet 30 is. The adhesive layer 32 having the thickness of 0.8 μm or more easily follows irregularities on the surface of the base material 31, which can improve the adhesive strength. Setting the thickness of the adhesive layer 32 to 0.8 μm or more can easily reduce the thermal conductivity of the metallic sheet 30 to 0.34 W/m·K or less and improve adhesion between the toner layer and the metallic sheet 30. The adhesive layer having the thickness less than 0.8 μm increases the thermal conductivity of the metallic sheet and may degrade adhesion between the toner layer and the metallic sheet. A thickness of the adhesive layer of less than 0.8 μm tends to cause incomplete adhesion between the base material and the plastic layer having the metallic layer and partially different reflection of light, which may not give a beautiful metallic sheet.

Setting the thickness of the adhesive layer 32 to 15 μm or less can prevent the production cost from increasing and improve the mechanical strength of the metallic sheet. In contrast, setting the thickness of the adhesive layer to larger than 15 μm results in uneven thickness of the adhesive layer and prevents an adhesive surface of the plastic layer having the metallic layer becoming smooth. This may cause partially unnatural reflection of light and detract from the beauty of the metallic sheet. In addition, deformation of the metallic sheet may occur when the metallic sheet is handled or processed.

Examples of the base material 31 of the metallic sheet 30 include plain paper, coated paper, and high-quality paper. Preferably, the base material 31 is coated paper having a smooth surface considering adhesion between the base material 31 and the plastic layer 34 having a metallic layer 33 and the reflectance of metallic sheet 30.

Considering the use of the metallic sheet 30, it is preferable that the base material 31 has a certain thickness, that is, 100 GSM to 350 GSM in the basis weight of the base material 31.

As described above, the metallic sheet 30 in the present embodiment preferably has a configuration including the base material 31, the adhesive layer 32 formed on the base material 31, the metallic layer 33 including metal and formed on the adhesive layer 32, and the resin layer 34 (the plastic layer 34) formed on the metallic layer 33. In addition, it is more preferable to provide the anchor coat layer on the plastic layer 34. The above configuration can improve adhesion between the toner layer and the metallic sheet 30 and the flexibility and workability of the metallic sheet 30.

The image forming method of the present embodiment provides high quality toner image having the toner layer that sufficiently adheres to the metallic sheet 30. The toner image in the present embodiment is obtained by transferring a white toner layer 41 on the metallic sheet 30, transferring a color toner layer 42 on the white toner layer 41, and fixing the toner layers 41 and 42 onto the metallic sheet 30. In the present embodiment, the color toner layer 42 including the white toner layer 41 as the lowermost layer is transferred to the metallic sheet, but only the white toner layer 41 may be transferred to a part of the metallic sheet 30, or only the color toner layer 42 may be transferred to a part of the metallic sheet 30.

Next, with reference to FIG. 1, a description is given of an image forming apparatus 1 that uses the image forming method according to the present disclosure.

Image Reader

An image reader 11 optically reads an image recorded on a sheet and generates image data. Specifically, the image reader 11 irradiates the original with light. A reading sensor such as a charge coupled device (CCD) or a contact image sensor (CIS) receives the light reflected by the original and reads the light into image data. The image data is information defining a toner image to be formed on a recording medium such as the sheet and is constructed of electrical color separation image signals indicating red (R), green (G), and blue (B), respectively.

As illustrated in FIG. 1, the image reader 11 includes an exposure glass 111 and a reading sensor 112. The original bearing the image is placed on the exposure glass 111. The reading sensor 112 reads the image on the original placed on the exposure glass 111 into image data.

Image Forming Device

A detailed description is now given of a construction and operation of an image forming device 12 of the image forming apparatus 1. The image forming device 12 adheres toner to an outer circumferential surface of an intermediate transfer belt 143 of a transfer device 14 according to the image data created by the image reader 11 or image data received by the network I/F, thus forming the toner image on the outer circumferential surface of the intermediate transfer belt 143.

The image forming device 12 includes an image forming unit 120C to form a toner image using a developer having a cyan (C) color toner, an image forming unit 120M to form a toner image using a magenta (M) color toner, an image forming unit 120Y to form a toner image using a yellow (Y) color toner, an image forming unit 120K to form a toner image using a black (K) color toner, and an image forming unit 120W to form a toner image using a white (W) toner.

At least one of the cyan toner, the magenta toner, the yellow toner, and the black toner is hereinafter referred to as color toner or process color toner. The color toner includes charged resin particles containing a coloring material such as a pigment and a dye.

The white toner includes charged resin particles containing a white pigment.

The image forming device 12 may include an image forming unit to form a toner image using a developer having a transparent clear toner or a color toner other than the cyan toner, the magenta toner, the yellow toner, and the black toner.

An arbitrary image forming unit selected from the image forming units 120C, 120M, 120Y, 120K, and 120W is hereinafter referred to as an image forming unit 120.

The image forming unit 120C includes a toner supply 121C, a photoconductor drum 122C, a charger 123C, an exposure device 124C, a developing device 125C, a discharger 126C, and a cleaner 127C.

The toner supply 121C contains the cyan toner to be supplied to the developing device 125C A conveying screw disposed inside the toner supply 121C is driven to convey a predetermined amount of the cyan toner to the developing device 125C.

The charger 123C uniformly changes an outer circumferential surface of the photoconductor drum 122C. The exposure device 124C forms an electrostatic latent image on the outer circumferential surface of the photoconductor drum 122C according to the image data sent from the controller 10. The developing device 125C adheres the cyan toner to the electrostatic latent image formed on the outer circumferential surface of the photoconductor drum 122C, visualizing the electrostatic latent image into a cyan toner image. The photoconductor drum 122C contacts the intermediate transfer belt 143 at a contact point at which the photoconductor drum 122C rotates in the same direction as a rotational direction of the intermediate transfer belt 143.

The charger 123C uniformly charges the outer circumferential surface of the photoconductor drum 122C.

The exposure device 124C irradiates the outer circumferential surface of the photoconductor drum 122C charged by the charger 123C with light according to a dot area rate (e.g., a halftone area rate) of the cyan toner image that is determined by the controller 10, thus forming the electrostatic latent image on the photoconductor drum 122C.

The developing device 125C adheres the cyan toner supplied from the toner supply 121C to the electrostatic latent image formed on the outer circumferential surface of the photoconductor drum 122C by the exposure device 124C, visualizing the electrostatic latent image into the cyan toner image.

After the cyan toner image is primarily transferred onto the intermediate transfer belt 143, the discharger 126C discharges the outer circumferential surface of the photoconductor drum 122C. The cleaner 127C removes residual toner failed to be transferred onto the intermediate transfer belt 143 and therefore remaining on the outer circumferential surface of the photoconductor drum 122C that is discharged by the discharger 126C, from the photoconductor drum 122C.

The image forming unit 120M includes a toner supply 121M, a photoconductor drum 122M, a charger 123M, an exposure device 124M, a developing device 125M, a discharger 126M, and a cleaner 127M. The toner supply 121M contains the magenta toner. Since the photoconductor drum 122M, the charger 123M, the exposure device 124M, the developing device 125M, the discharger 126M, and the cleaner 127M operate similarly to the photoconductor drum 122C, the charger 123C, the exposure device 124C, the developing device 125C, the discharger 126C, and the cleaner 127C, a description of an operation of the photoconductor drum 122M, the charger 123M, the exposure device 124M, the developing device 125M, the discharger 126M, and the cleaner 127M is omitted.

The image forming unit 120Y includes a toner supply 121Y, a photoconductor drum 122Y, a charger 123Y, an exposure device 124Y, a developing device 125Y, a discharger 126Y, and a cleaner 127Y. The toner supply 121Y accommodates the yellow toner. Since the photoconductor drum 122Y, the charger 123Y, the exposure device 124Y, the developing device 125Y, the discharger 126Y, and the cleaner 127Y operate similarly to the photoconductor drum 122C, the charger 123C, the exposure device 124C, the developing device 125C, the discharger 126C, and the cleaner 127C, a description of an operation of the photoconductor drum 122Y, the charger 123Y, the exposure device 124Y, the developing device 125Y, the discharger 126Y, and the cleaner 127Y is omitted.

The image forming unit 120K includes a toner supply 121K, a photoconductor drum 122K, a charger 123K, an exposure device 124K, a developing device 125K, a discharger 126K, and a cleaner 127K. The toner supply 121K contains the black toner. Since the photoconductor drum 122K, the charger 123K, the exposure device 124K, the developing device 125K, the discharger 126K, and the cleaner 127K operate similarly to the photoconductor drum 122C, the charger 123C, the exposure device 124C, the developing device 125C, the discharger 126C, and the cleaner 127C, a description of an operation of the photoconductor drum 122K, the charger 123K, the exposure device 124K, the developing device 125K, the discharger 126K, and the cleaner 127K is omitted.

The image forming unit 120W includes a toner supply 121W, a photoconductor drum 122W, a charger 123W, an exposure device 124W, a developing device 125W, a discharger 126W, and a cleaner 127W. The toner supply 121W contains the white toner. Since the photoconductor drum 122W, the charger 123W, the exposure device 124W, the developing device 125W, the discharger 126W, and the cleaner 127W operate similarly to the photoconductor drum 122C, the charger 123C, the exposure device 124C, the developing device 125C, the discharger 126C, and the cleaner 127C, a description of an operation of the photoconductor drum 122W, the charger 123W, the exposure device 124W, the developing device 125W, the discharger 126W, and the cleaner 127W is omitted.

An arbitrary toner supply selected among the toner supplies 121C, 121M, 121Y, 121K, and 121W is hereinafter referred to as a toner supply 121. An arbitrary photoconductor drum selected among the photoconductor drums 122C, 122M, 122Y, 122K, and 122W is hereinafter referred to as a photoconductor drum 122. An arbitrary charger selected among the chargers 123C, 123M, 123Y, 123K, and 123W is hereinafter referred to as a charger 123. An arbitrary exposure device selected among the exposure devices 124C, 124M, 124Y, 124K, and 124W is hereinafter referred to as an exposure device 124. An arbitrary developing device selected among the developing devices 125C, 125M, 125Y, 125K, and 125W is hereinafter referred to as a developing device 125. An arbitrary discharger selected among the dischargers 126C, 126M, 126Y, 126K, and 126W is hereinafter referred to as a discharger 126. An arbitrary cleaner selected among the cleaners 127C, 127M, 127Y, 127K, and 127W is hereinafter referred to as a cleaner 127.

The order of toner to be transferred to the intermediate transfer belt 143 is such that white toner is transferred last, and the order of toners other than white toner, that is, the cyan toner, the magenta toner, the yellow toner, and the black toner does not matter. That is, the image forming unit 120W is arranged at the last position. In the present embodiment, a white toner is transferred to a portion to which at least one of the cyan toner image, the magenta toner image, the yellow toner image, and the black toner image is transferred.

Sheet Feeder

A detailed description is now given of a construction and operation of a sheet feeder 13 of the image forming apparatus 1. The sheet feeder 13 supplies the sheet to the transfer device 14. The sheet feeder 13 includes a sheet tray 131, a feed roller 132, a feed belt 133, and a registration roller pair 134.

The sheet tray 131 loads a plurality of sheets serving as one example of recording media. As the feed roller 132 rotates, the feed roller 132 moves the sheet from the sheet tray 131 to the feed belt 133. For example, the feed roller 132 picks up and feeds an uppermost sheet of the plurality of sheets loaded on the sheet tray 131 onto the feed belt 133.

The feed belt 133 conveys the uppermost sheet picked up by the feed roller 132 to the transfer device 14. The registration roller pair 134 feeds the sheet conveyed by the feed belt 133 to the transfer device 14 at a time when a toner image formed on the intermediate transfer belt 143 reaches the transfer device 14.

Transfer Device

A detailed description is now given of a construction and operation of the transfer device 14 in the image forming apparatus 1. The transfer device 14 primarily transfers a toner image formed on the photoconductor drum 122 by the image forming device 12 onto the intermediate transfer belt 143 and secondarily transfers the toner image transferred on the intermediate transfer belt 143 onto the sheet.

The transfer device 14 includes a driving roller 141, a driven roller 142, the intermediate transfer belt 143, primary transfer rollers 144C, 144M, 144Y, 144K, and 144W, a secondary transfer roller 145, and a secondary transfer opposing roller 146.

The intermediate transfer belt 143 is looped over the driving roller 141 and the driven roller 142. As a driver drives and rotates the driving roller 141, the driving roller 141 rotates the intermediate transfer belt 143 looped over the driving roller 141. The driving roller 141 and the driven roller 142 support the intermediate transfer belt 143. As the driving roller 141 rotates the intermediate transfer belt 143, the intermediate transfer belt 143 rotates the driven roller 142.

As the driving roller 141 rotates the intermediate transfer belt 143 looped over the driving roller 141 and the driven roller 142, the intermediate transfer belt 143 rotates while contacting the photoconductor drums 122. As the intermediate transfer belt 143 rotates while contacting the photoconductor drums 122, the cyan, magenta, yellow, black, and white toner images formed on the photoconductor drums 122 are primarily transferred onto the outer circumferential surface of the intermediate transfer belt 143.

The primary transfer rollers 144C, 144M, 144Y, 144K, and 144W are disposed opposite the photoconductor drums 122C, 122M, 122Y, 122K, and 122W via the intermediate transfer belt 143, respectively. As the primary transfer rollers 144C, 144M, 144Y, 144K, and 144W rotate clockwise in FIG. 1, the primary transfer rollers 144C, 144M, 144Y, 144K, and 144W rotate the intermediate transfer belt 143.

The secondary transfer roller 145 rotates while the secondary transfer roller 145 and the secondary transfer opposing roller 146 sandwich the intermediate transfer belt 143 and the sheet. The secondary transfer opposing roller 146 rotates while the secondary transfer roller 145 and the secondary transfer opposing roller 146 sandwich the intermediate transfer belt 143 and the sheet.

Fixing Device

A detailed description is now given of a construction and operation of a fixing device 15 in the image forming apparatus 1. The fixing device 15 fixes the toner image secondarily transferred by the transfer device 14 on the sheet. The fixing device 15 applies heat and pressure to the toner image on the sheet to melt and fix a resin component of toner of the toner image on the sheet. After the fixing device 15 fixes the toner image secondarily transferred by the transfer device 14 on the sheet, the toner of the toner image on the sheet attains a stable state.

The fixing device 15 includes a conveyance belt 151, a fixing belt 152, a fixing roller 153, a fixing belt driving roller 154, a fixing roller opposing roller 155, and a heater 156.

The conveyance belt 151 as a conveyor conveys the sheet bearing the toner image secondarily transferred by the transfer device 14 to a fixing nip formed between the fixing roller opposing roller 155 and the fixing belt 152 supported by the fixing roller 153. The fixing belt 152 is looped over the fixing roller 153 and the fixing belt driving roller 154. As the fixing roller 153 and the fixing belt driving roller 154 rotate, the fixing roller 153 and the fixing belt driving roller 154 rotate the fixing belt 152. While the sheet is conveyed by the conveyance belt 151 through the fixing nip formed between the fixing belt 152 and the fixing roller opposing roller 155 that is disposed opposite the fixing roller 153 via the fixing belt 152, the fixing belt 152 and the fixing roller opposing roller 155 fix the toner image on the sheet under heat and pressure.

In this embodiment, the fixing belt 152 and the fixing roller 153 are used as the fixing rotator, but the configuration of the fixing rotator is not limited thereto. For example, only the fixing roller may be used without using the fixing belt. A heater may be disposed inside the fixing roller.

The fixing belt driving roller 154 and the fixing roller 153 support the fixing belt 152. As the fixing belt driving roller 154 rotates, the fixing belt driving roller 154 rotates the fixing belt 152.

In the present embodiment, the fixing roller opposing roller 155 is used as the pressing rotator. The fixing roller opposing roller 155 is disposed opposite the fixing roller 153 via the fixing belt 152. The fixing belt 152 and the fixing roller opposing roller 155 sandwich the sheet while the sheet is conveyed through the fixing nip.

The heater 156 is disposed inside the fixing belt driving roller 154 to heat the fixing belt driving roller 154. The heater 156 heats the fixing belt driving roller 154, the temperature of the fixing belt driving roller 154 rise, and the fixing belt 152 is heated. The heated fixing belt 152 rotates and heats the sheet.

The heater 156 is disposed inside the fixing belt driving roller 154 in FIG. 1 but may be disposed anywhere as long as the heater 156 can heat the fixing belt 152. For example, if the heater 156 is an induction heater (an IH heater), the heater 156 may be outside the fixing belt driving roller 154 and the fixing belt 152. Without using the fixing belt 152, only the fixing roller 153 with the heater 156 inside may be used.

Sheet Ejection Device

A detailed description is now given of a construction of a sheet ejection device 16 in the image forming apparatus 1. The sheet ejection device 16 ejects the sheet bearing the toner image fixed in the fixing device 15 to an outside of the image forming apparatus 1. The sheet ejection device 16 includes an ejection belt 161, an ejection roller 162, an outlet 163, and an output tray 164.

The ejection belt 161 conveys the sheet bearing the fixed toner image to the outlet 163. The ejection roller 162 ejects the sheet conveyed by the ejection belt 161 onto the output tray 164 through the outlet 163. The output tray 164 stacks the sheet ejected by the ejection roller 162.

Control Panel

A detailed description is now given of a construction of the control panel 17 of the image forming apparatus 1. The control panel 17 includes a display panel portion 171 and an operation portion 172. The display panel portion 171 displays settings, selection screens, and the like. The display panel portion 171 includes a touch panel with which the user inputs an instruction. The operation portion 172 includes ten keys with which the user inputs various settings for image formation and a start key with which the user inputs an instruction to start a print job.

EXAMPLES

Further understanding can be obtained by reference to certain specific examples which are provided herein for the purpose of illustration only and are not intended to be limiting.

Example 1

Aluminum was vapor-deposited on one surface of a polyethylene terephthalate (PET) film having a thickness of 64 μm, and styrene acrylic resin was applied as the anchor coat layer to have a thickness of 6.5 μm on a surface opposite to the aluminum vapor-deposited surface. The acrylic pressure-sensitive adhesive was provided on the surface of a coated paper having a basis weight of 275 GSM to form a layer having a thickness of 10 μm. The surface of the acrylic pressure-sensitive adhesive layer on the coated paper was bonded to the aluminum-deposited surface of the PET film to produce the metallic sheet.

The quick thermal conductivity meter QTM-500 manufactured by KYOTO ELECTRONICS MANUFACTURING CO., LTD measured the thermal conductivity of the produced metallic sheet with the metallic glossy surface facing upward at 23±1° C. and 50±5%. Quartz glass, silicon rubber, and silicon sponge rubber were used as reference plates. The thermal conductivity of the produced metallic sheet was 0.247 W/m·K.

A toner image was formed on the produced metallic sheet by the electrophotographic image forming method. A color production printer Pro C7200 S manufactured by Ricoh Co. Ltd. was customized and used as the image forming apparatus. The Pro C7200 S is the image forming apparatus as illustrated in FIG. 1, does not have the heater inside a pressure roller, and uses the white toner, the cyan toner, the magenta toner, the yellow toner, and the black toner to form the toner image. Generally, when the Pro C7200 S forms the toner image on a thick sheet like the metallic sheet, the paper sensor of the Pro C7200 S detects that the sheet is the thick sheet, and the controller slows down the print speed to increase the amount of heat supplied to the toner image, which is called a medium speed mode. In the customized Pro C7200 S in the present embodiment, the signal of the paper sensor was blocked to form the toner image on the metallic sheet in a normal print speed, that is, a high-speed mode.

First, in the high-speed mode, the Pro C7200 superimposed a solid white image and a magenta solid image to form a toner image, and the present inventors evaluated adhesion between the metallic sheet and a toner layer that forms the toner image. The toner image given by the above was very clear, and adhesion between the toner layer forming the toner image and the metallic sheet was excellent. Next, the present inventors turned signal lines of the paper sensor to normal, and the Pro C7200 sequentially superimposed a white solid image, a cyan solid image, a magenta solid image, a yellow solid image, and a black solid image on the metallic sheet to form a superimposed image in the medium speed mode. The toner image given by the above was very clear, and adhesion between the toner layer forming the toner image and the metallic sheet was excellent.

Example 2

A metallic sheet in the example 2 was produced by setting a thickness of the acrylic pressure-sensitive adhesive to 1.1 mm and setting other conditions to the same as those in the example 1. The thermal conductivity of the produced metallic sheet was 0.318 W/m·K. In the same manner as in the example 1, toner images were formed on the metallic sheets in the medium speed mode and the high-speed mode. In each of samples, the toner image given by the above was very clear, and adhesion between the toner layer forming the toner image and the metallic sheet was excellent.

Example 3

Aluminum was vapor-deposited on one surface of a polyvinyl alcohol (PVA) film having a thickness of 42 μm, and styrene acrylic resin was applied as the anchor coat layer to have a thickness of 5.2 μm on a surface opposite to the aluminum vapor-deposited surface. The acrylic pressure-sensitive adhesive was provided on the surface of the coated paper having a basis weight of 300 GSM to form a layer having a thickness of 7 μm. The surface of the acrylic pressure-sensitive adhesive layer on the coated paper was bonded to the aluminum-deposited surface of the PVA film to produce the metallic sheet. The quick thermal conductivity meter QTM-500 manufactured by KYOTO ELECTRONICS MANUFACTURING CO., LTD measured the thermal conductivity of the produced metallic sheet with the metallic glossy surface facing upward at 23±1° C. and 50±5%. Quartz glass, silicon rubber, and silicon sponge rubber were used as the reference plates. The thermal conductivity of the produced metallic sheet was 0.271 W/m·K. In the same manner as in the example 1, toner images were formed on the metallic sheets in the medium speed mode and the high-speed mode. In each of samples, the toner image given by the above was very clear, and adhesion between the toner layer forming the toner image and the metallic sheet was excellent.

Example 4

Aluminum was vapor-deposited on one surface of the PET film having a thickness of 16 μm, and polyester resin was applied as the anchor coat layer to have a thickness of 2.3 μm on the surface opposite to the aluminum vapor-deposited surface. The acrylic pressure-sensitive adhesive was provided on the surface of the coated paper having a basis weight of 300 GSM to form a layer having a thickness of 8 μm. The surface of the acrylic pressure-sensitive adhesive layer on the coated paper was bonded to the aluminum-deposited surface of the PET film to produce the metallic sheet. The quick thermal conductivity meter QTM-500 manufactured by KYOTO ELECTRONICS MANUFACTURING CO., LTD measured the thermal conductivity of the produced metallic sheet with the metallic glossy surface facing upward at 23±1° C. and 50±5%. Quartz glass, silicon rubber, and silicon sponge rubber were used as the reference plates. The thermal conductivity of the produced metallic sheet was 0.302 W/m·K. In the same manner as in the example 1, toner images were formed on the metallic sheets in the medium speed mode and the high-speed mode. In each of samples, the toner image given by the above was very clear, and adhesion between the toner layer forming the toner image and the metallic sheet was excellent.

Example 5

Aluminum was vapor-deposited on one surface of the PET film having a thickness of 11 μm, and polymethacrylate resin was applied as the anchor coat layer to have a thickness of 0.5 μm on the surface opposite to the aluminum vapor-deposited surface. An acrylic adhesive was provided at 8 μm on the surface of a coated paper having a basis weight of 310 GSM. The surface of the acrylic pressure-sensitive adhesive layer on the coated paper was bonded to the aluminum-deposited surface of the PET film to produce the metallic sheet. The quick thermal conductivity meter QTM-500 manufactured by KYOTO ELECTRONICS MANUFACTURING CO., LTD measured the thermal conductivity of the produced metallic sheet with the metallic glossy surface facing upward at 23±1° C. and 50±5%. Quartz glass, silicon rubber, and silicon sponge rubber were used as the reference plates. The thermal conductivity of the produced metallic sheet was 0.336 W/m·K. In the same manner as in the example 1, toner images were formed on the metallic sheets in the medium speed mode and the high-speed mode. In each of samples, the toner image given by the above was very clear, and adhesion between the toner layer forming the toner image and the metallic sheet was weaker than other results described above at a part of the image but enough in a practical use.

Comparative Example 1

Aluminum was vapor-deposited on one surface of the PET film having a thickness of 8 μm, and polymethacrylate resin was applied as the anchor coat layer to have a thickness of 0.5 μm on the surface opposite to the aluminum vapor-deposited surface. The acrylic pressure-sensitive adhesive was provided on the surface of the coated paper having a basis weight of 310 GSM to form a layer having a thickness of 0.7 μm. The surface of the acrylic pressure-sensitive adhesive layer on the coated paper was bonded to the aluminum-deposited surface of the PET film to produce the metallic sheet. The quick thermal conductivity meter QTM-500 manufactured by KYOTO ELECTRONICS MANUFACTURING CO., LTD measured the thermal conductivity of the produced metallic sheet with the metallic glossy surface facing upward at 23±1° C. and 50±5%. Quartz glass, silicon rubber, and silicon sponge rubber were used as the reference plates. The thermal conductivity of the produced metallic sheet was 0.355 W/m·K. In the same manner as in the example 1, toner images were formed on the metallic sheets in the medium speed mode and the high-speed mode. Each of obtained samples had an insufficient adhesion between the toner layer and the metallic sheet. Tables 1A to 1 C illustrate the configuration of each layer of the metallic sheets, the thermal conductivities, and whether the pressing rotator has the heater in the above-described Examples and the Comparative Example. Tables 1A to 1 C also illustrate above-described information in the following Examples and Comparative Examples.

Examples 6 to 9 and Comparative Example 2

Aluminum was vapor-deposited on one surface of the PET film, and polyester resin was applied as the anchor coat layer to have a thickness of 10 μm on the surface opposite to the aluminum vapor-deposited surface. The acrylic pressure-sensitive adhesive was provided on the surface of the coated paper having a basis weight of 290 GSM. The surface of the acrylic pressure-sensitive adhesive layer on the coated paper was bonded to the aluminum-deposited surface of the PET film to produce the metallic sheet. As illustrated in Tables 1A to 1 C below, the thickness of the PET film and the thickness of the acrylic pressure-sensitive adhesive were changed to produce metallic sheets having different thermal conductivities. The present inventors evaluated adhesion between each produced metallic sheet and the toner layer that forms the toner image in the same manner as in Example 1. Table 2 illustrates the results of evaluation of adhesion.

Example 10

A metallic sheet in the example 10 was produced by setting a thickness of the acrylic pressure-sensitive adhesive to 14.5 μm and setting other conditions to the same as those in the example 1. The thermal conductivity of the produced metallic sheet was 0.229 W/m·K. In the same manner as in the example 1, toner images were formed on the metallic sheet in the medium speed mode and the high-speed mode. In each of samples, the toner image given by the above was very clear, and adhesion between the toner layer forming the toner image and the metallic sheet was excellent.

Comparative Example 3

The same metallic sheet as in Example 10 was produced. Pro C7200 S was customized to have a heating mechanism in the pressure roller. In the same manner as in the example 1, toner images were formed on the metallic sheet in the medium speed mode and the high-speed mode. In each of samples, adhesion between the toner layer forming the toner image and the metallic sheet was enough, but reflection of the metallic sheet becomes ununiform, which made it impossible to get a beautiful toner image on the metallic sheet.

TABLE 1A

| | BASE MATERIAL | | ADHESIVE LAYER | | |
|---|---|---|---|---|---|
| | TYPE | GSM | TYPE | THICKNESS [μm] | METALLIC LAYER |
| EXAMPLE 1 | COATED PAPER | 275 | ACRYLIC | 10 | ALUMINUM |
| EXAMPLE 2 | COATED PAPER | 275 | ACRYLIC | 1.1 | ALUMINUM |
| EXAMPLE 3 | COATED PAPER | 300 | ACRYLIC | 7 | ALUMINUM |
| EXAMPLE 4 | COATED PAPER | 300 | ACRYLIC | 8 | ALUMINUM |
| EXAMPLE 5 | COATED PAPER | 310 | ACRYLIC | 8 | ALUMINUM |
| COMPARATIVE EXAMPLE 1 | COATED PAPER | 310 | ACRYLIC | 0.7 | ALUMINUM |
| EXAMPLE 6 | COATED PAPER | 290 | ACRYLIC | 2.5 | ALUMINUM |
| EXAMPLE 7 | COATED PAPER | 290 | ACRYLIC | 1.5 | ALUMINUM |
| EXAMPLE 8 | COATED PAPER | 290 | ACRYLIC | 1.0 | ALUMINUM |

TABLE 1A-continued

| | BASE MATERIAL | | ADHESIVE LAYER | | |
|---|---|---|---|---|---|
| | TYPE | GSM | TYPE | THICKNESS [μm] | METALLIC LAYER |
| EXAMPLE 9 | COATED PAPER | 290 | ACRYLIC | 0.9 | ALUMINUM |
| COMPARATIVE EXAMPLE 2 | COATED PAPER | 290 | ACRYLIC | 0.6 | ALUMINUM |
| EXAMPLE 10 | COATED PAPER | 275 | ACRYLIC | 14.5 | ALUMINUM |
| COMPARATIVE EXAMPLE 3 | COATED PAPER | 275 | ACRYLIC | 14.5 | ALUMINUM |

TABLE 1B

| | PLASTIC LAYER | | ANCHOR COAT LAYER | |
|---|---|---|---|---|
| | TYPE | THICKNESS [μm] | TYPE | THICKNESS [μm] |
| EXAMPLE 1 | PET | 64 | STYRENE ACRYLIC RESIN | 6.5 |
| EXAMPLE 2 | PET | 64 | STYRENE ACRYLIC RESIN | 6.5 |
| EXAMPLE 3 | PVA | 42 | STYRENE ACRYLIC RESIN | 5.2 |
| EXAMPLE 4 | PET | 16 | POLYESTER RESIN | 2.3 |
| EXAMPLE 5 | PET | 11 | POLYMETHACRYLATE RESIN | 0.5 |
| COMPARATIVE EXAMPLE 1 | PET | 8 | POLYMETHACRYLATE RESIN | 0.5 |
| EXAMPLE 6 | PET | 40 | POLYESTER RESIN | 10 |
| EXAMPLE 7 | PET | 40 | POLYESTER RESIN | 10 |
| EXAMPLE 8 | PET | 55 | POLYESTER RESIN | 10 |
| EXAMPLE 9 | PET | 60 | POLYESTER RESIN | 10 |
| COMPARATIVE EXAMPLE 2 | PET | 75 | POLYESTER RESIN | 10 |
| EXAMPLE 10 | PET | 64 | STYRENE ACRYLIC RESIN | 6.5 |
| COMPARATIVE EXAMPLE 3 | PET | 64 | STYRENE ACRYLIC RESIN | 6.5 |

TABLE 1C

| | THERMAL CONDUCTIVITY [W/m · K] | DOES PRESSURE ROTATOR HEAT SHEET? |
|---|---|---|
| EXAMPLE 1 | 0.247 | NO |
| EXAMPLE 2 | 0.318 | NO |
| EXAMPLE 3 | 0.271 | NO |
| EXAMPLE 4 | 0.302 | NO |
| EXAMPLE 5 | 0.336 | NO |
| COMPARATIVE EXAMPLE 1 | 0.355 | NO |
| EXAMPLE 6 | 0.293 | NO |
| EXAMPLE 7 | 0.314 | NO |
| EXAMPLE 8 | 0.329 | NO |
| EXAMPLE 9 | 0.338 | NO |
| COMPARATIVE EXAMPLE 2 | 0.369 | NO |
| EXAMPLE 10 | 0.229 | NO |
| COMPARATIVE EXAMPLE 3 | 0.229 | YES |

TABLE 2

| | THERMAL CONDUCTIVITY [W/m · K] | ADHESION BETWEEN TONER LAYER AND METALLIC SHEET |
|---|---|---|
| EXAMPLE 6 | 0.293 | EXCELLENT |
| EXAMPLE 7 | 0.314 | EXCELLENT |
| EXAMPLE 8 | 0.329 | EXCELLENT |
| EXAMPLE 9 | 0.338 | PARTIALLY WEAK BUT NO PROBLEM IN PRACTICAL USE |
| COMPARATIVE EXAMPLE 2 | 0.369 | POOR |

The present disclosure is not limited to the above-described embodiments, and the configuration of the present embodiment can be appropriately modified other than suggested in each of the above embodiments within a scope of the technological concept of the present disclosure. Also, the positions, the shapes, and the number of components are not limited to the embodiments, and they may be modified suitably in implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

What is claimed is:

1. An image forming method for an image forming apparatus including a fixing rotator and a pressure rotator opposite the fixing rotator, the method comprising:

transferring white toner and color toner onto a surface of a metallic sheet having a thermal conductivity of 0.34 W/m·K or less, as measured by hot-wire method, to form an unfixed color toner layer layered on an unfixed white toner layer on the metallic sheet, wherein the metallic sheet includes a base material, an adhesive layer on the base material, a metallic layer on the adhesive layer, the metallic layer including metal, and a resin layer on the metallic layer, and wherein a thickness of the adhesive layer is from 0.8 μm to 15 μm; and conveying the metallic sheet, with the surface on which the white toner layer and the color toner layer are transferred facing the fixing rotator, between the fixing rotator heated and the pressure rotator, to fix the white toner layer and the color toner layer onto the metallic sheet.

2. The image forming method according to claim 1, wherein the metallic sheet includes a metallic layer including a metal, and wherein a surface of the metallic layer is formed at a position 10 μm to 100 μm from a surface of the metallic sheet in a direction from the surface of the metallic sheet to the surface of the metallic layer, the direction being perpendicular to the surface of the metallic layer.

3. The image forming method according to claim 1, wherein the adhesive layer is made of an acrylic adhesive.

4. An image firming apparatus configured to form an image on a metallic sheet, the apparatus comprising:

a fixing rotator;

a heater configured to heat the fixing rotator;

a pressure rotator opposite the fixing rotator, wherein the pressure rotator does not include a heater;

a transfer device configured to transfer white toner and color toner onto a surface of the metallic sheet having a thermal conductivity of 0.34 W/m·K or less, as measured by hot-wire method, to form an unfixed color toner layer layered on an unfixed white toner layer on the metallic sheet; and a conveyor configured to convey the metallic sheet, with the surface on which the white toner layer and the color toner layer are transferred facing the fixing rotator, between the fixing rotator heated by the heater and the pressure rotator, to fix the white toner layer and the color toner layer onto the metallic sheet.

5. An image forming method for an image forming apparatus including a fixing rotator and a pressure rotator opposite the fixing rotator, the method comprising:

transferring white toner and color toner onto a surface of a metallic sheet having a thermal conductivity of 0.34 W/m·K or less, as measured by a hot-wire method, to form an unfixed color toner layer layered on an unfixed white toner layer on the metallic sheet; and conveying the metallic sheet, with the surface on which the white toner layer and the color toner layer are transferred facing the fixing rotator, between the fixing rotator heated and the pressure rotator, to fix the white toner layer and the color toner layer onto the metallic sheet, wherein the metallic sheet includes a base material, an acrylic adhesive layer on the base material, and a metallic layer on the acrylic adhesive layer, and a thickness of the adhesive layer is from 0.8 μm to 15 μm.

6. An image forming method for an image forming apparatus including a fixing rotator and a pressure rotator opposite the fixing rotator, the method comprising:

transferring white toner and color toner onto a surface of a metallic sheet having a thermal conductivity of 0.34 W/m·K or less as measured by a hot-wire method, to form an unfixed color toner layer layered on an unfixed white toner layer on the metallic sheet; and conveying the metallic sheet, with the surface on which the white toner layer and the color toner layer are transferred facing the fixing rotator, between the fixing rotator heated and the pressure rotator, to fix the white toner layer and the color toner layer onto the metallic sheet, wherein the metallic sheet includes a base material, an adhesive layer having a thickness from 0.8 μm to 15 μm on the base material, a metallic layer on the adhesive layer, the metallic layer including metal, and a resin layer on the metallic layer.

7. The image forming method according to claim 6, wherein a surface of the metallic layer is formed at a position 10 μm to 100 μm from the surface of the metallic sheet in a direction from the surface of the metallic layer to the surface of the metallic sheet, the direction being perpendicular to the surface of the metallic layer.

8. The image forming method according to claim 6, wherein the adhesive layer is made of an acrylic adhesive on the base material.

9. An image forming apparatus configured to form an image on a metallic sheet, the apparatus comprising:

a fixing rotator;

a heater configured to heat the fixing rotator;

a pressure rotator opposite the fixing rotator;

a transfer device configured to transfer white toner and color toner onto a surface of the metallic sheet having a thermal conductivity of 0.34 W/m·K or less, as measured by hot-wire method, to form an unfixed color toner layer layered on an unfixed white toner layer on the metallic sheet; and a conveyor configured to convey the metallic sheet, with the surface on which the white toner layer and the color toner layer are transferred facing the fixing rotator, between the fixing rotator heated by the heater and the pressure rotator to fix the white toner layer and the color toner layer onto the metallic sheet, wherein the metallic sheet includes a base material, an adhesive layer having a thickness from 0.8 μm to 15 μm on the base material, a metallic layer on the adhesive layer, the metallic layer including metal, and a resin layer on the metallic layer.

* * * * *